US008985729B1

(12) United States Patent
Able et al.

(10) Patent No.: US 8,985,729 B1
(45) Date of Patent: Mar. 24, 2015

(54) METHODS AND APPARATUS FOR AUTOMATIC RECOVERY WITHIN AN IMAGING DEVICE

(71) Applicant: Lexmark International Inc., Lexington, KY (US)

(72) Inventors: Douglas Anthony Able, Shelbyville, KY (US); David J Mickan, Lexington, KY (US); Kevin Dean Schoedinger, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/514,101

(22) Filed: Oct. 14, 2014

Related U.S. Application Data

(60) Provisional application No. 61/890,510, filed on Oct. 14, 2013.

(51) Int. Cl.
*B41J 29/38* (2006.01)
*B41J 13/00* (2006.01)

(52) U.S. Cl.
CPC ..... *B41J 13/0009* (2013.01)
USPC ..... 347/16; 347/101

(58) Field of Classification Search
CPC ..... B41J 3/4075; B41J 3/36; B41J 11/04; B41J 11/42; B41J 13/0009; B41J 13/0045; B41J 15/005; B41J 11/007; B41J 13/0036
USPC ..... 347/5, 16, 101, 104–106, 153–154, 347/164–165
See application file for complete search history.

(56) References Cited

U.S. PATENT DOCUMENTS 6,813,451 B2 * 11/2004 Wibbels ..... 399/45

* cited by examiner

*Primary Examiner* — Thinh Nguyen
(74) *Attorney, Agent, or Firm* — John Victor Pezdek

(57) ABSTRACT

A method and apparatus for handling a time based error condition in an imaging apparatus. The method includes transporting a first media sheet from the media input tray towards the transfer nip of the imaging apparatus; and determining, when the first media sheet reaches a predetermined point in the media path, whether the print engine of the imaging apparatus is ready to transfer a first image of the plurality of images to the media sheet at the transfer nip. Upon a determination that the print engine is not ready, the first media sheet is transported through the transfer nip without transferring the first image thereto, until the first media sheet is placed in the output area, and a second media sheet is transported to the transfer nip, a first image is transferred to the second media sheet and the second media sheet is transported to the output area.

19 Claims, 5 Drawing Sheets

METHODS AND APPARATUS FOR AUTOMATIC RECOVERY WITHIN AN IMAGING DEVICE

CROSS REFERENCES TO RELATED APPLICATIONS

The present application is related to U.S. patent application 61/890,510, filed Oct. 14, 2013 and titled, "Method and Apparatus for Automatic Recovery Within an Imaging Device," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present disclosure relates generally to a method and a system for feeding a media sheet through an image forming device and, more particularly, to a method and system for performing imaging operations on the media sheets during a timing based malfunction.

2. Description of the Related Art

A printing device, such as an electrophotographic printer or an inkjet printer, for example, typically includes a media sheet feed system for sequentially transporting sheets of media from a media input tray to a transfer location for transferring a toner image thereto and subsequently to an output area which the media sheets may be accessed by a user.

Manufacturers of printing devices are continually challenged to improve printing device performance. One way in which improvement is sought is to achieve higher throughput rates. To deliver higher throughput, there is a greater chance of encountering a timing related issue. For example, a media sheet may reach a predetermined location upstream of the imaging device's transfer nip where a toner image is transferred thereto, prior to the printing device's print engine being ready for the toner image transfer. This could be due to the print engine minor motor taking too long to settle to its imaging speed, the laser servo process taking too long to finish, or the media sheet appearing at the predetermined location earlier than expected. When this situation occurs in current and/or prior machines, an error message is posted at the user display panel and the user of the printing device is forced to intervene and handle the error condition. Typically when these types of errors occur there is no damage to the media sheet and it is not a real jam condition in the traditional sense in that the media sheet is not unable to be transported along the printing device's media path.

Another timing related issue stems from a narrowing of the interpage gap to increase throughput. When the gap between sheets of media was too narrow or even undetectable, prior printing devices posted a paper jam, stopped the printing operation and required the user to take various remedial steps, such as opening covers, removing supplies and clearing sheets of media.

SUMMARY

According to an example embodiment, there is shown an imaging apparatus having a media input tray, a print engine, an image transfer nip coupled to the print engine for transferring a toner image to sheet of media, an output area for maintaining imaged media sheets, a media path for transporting the media sheets from the media input tray through the image transfer nip and subsequently to the output area, and a plurality of path media sensors positioned along the media path between the media input tray and the output area. A controller executes a method for transferring a plurality of images to a plurality of media sheets, including transporting a first media sheet from the media input tray towards the transfer nip and determining, when the first media sheet reaches a predetermined point in the media path, whether the print engine is ready to transfer a first image of the plurality of images to the media sheet at the transfer nip. Upon a determination that the print engine is not ready, the method includes transporting the first media sheet through the transfer nip without transferring the first image thereto, until the first media sheet is placed in the output area, transporting a second media sheet to the transfer nip, transferring the first image to the second media sheet and transporting the second media sheet to the output area. In this way, a print operation is performed despite the occurrence of the timing based error condition.

In another example embodiment, the method addresses the situation in which the gap between successive sheets in the media path is small and tiny, which is smaller than small. In an example embodiment, if the gap is deemed to be small but not tiny, both media sheets are printed, either after predetermined timeout periods in which a leading or trailing edge of a media sheet is not detected or after predetermined predicted times which are based on locations where the sheet's edges are believed to exist. For tiny gaps, the downstream media sheet is printed and the upstream media sheet is flushed from the imaging apparatus without being imaged, with a further upstream media sheet being printed with the image originally intended for the flushed sheet.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
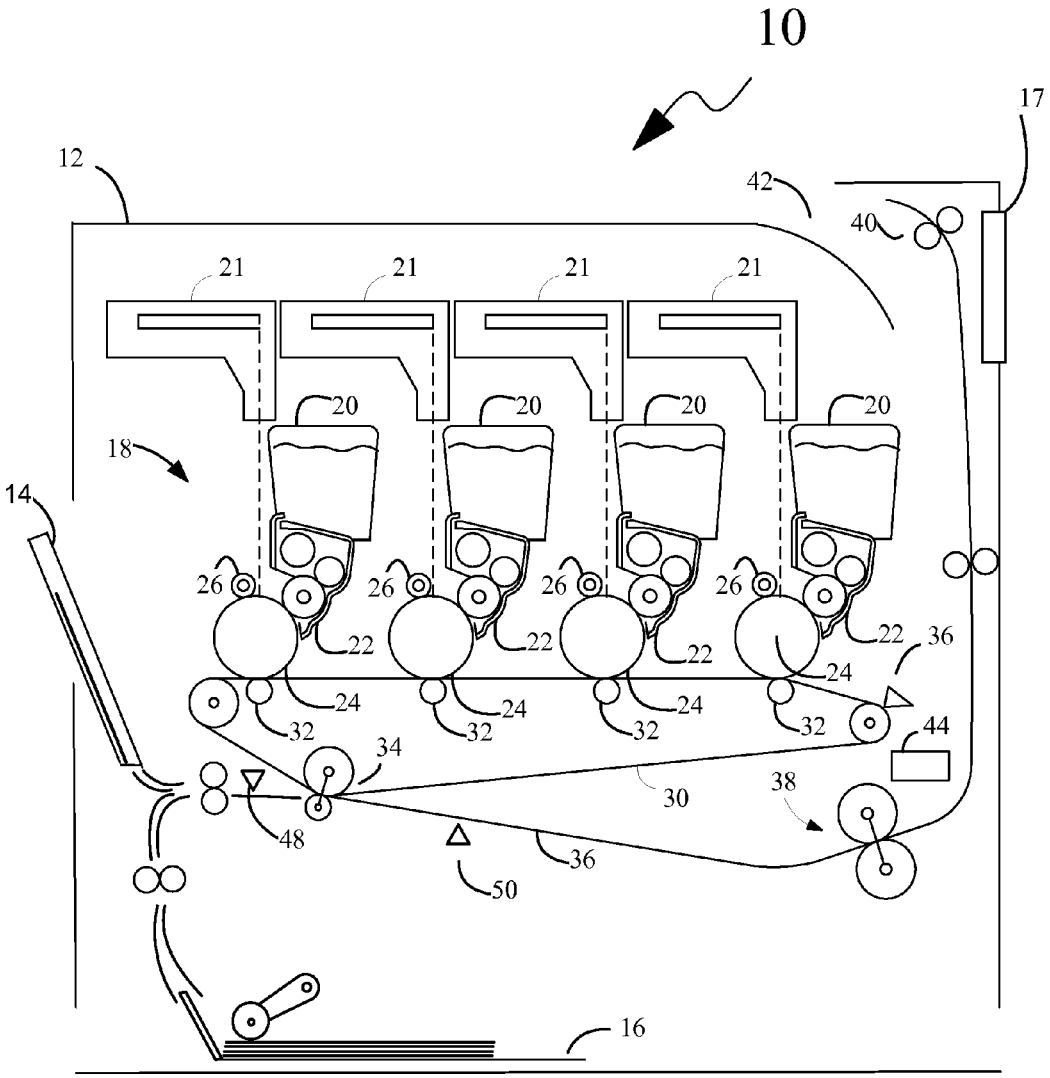
FIG. 1 is a perspective view of one example embodiment of an imaging apparatus.

The following description and drawings illustrate embodiments sufficiently to enable those skilled in the art to practice the present disclosure. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limiting sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side", "above", "under", "below", "lower", "over", "upper", and the like, are used for ease of description to explain the positioning of one element relative to a second element. These terms are generally used in reference to the position of an element in its intended working position within an image forming device. Further, terms such as "first", "second", and the like, are used to describe various elements, regions, sections, etc. and are not intended to be limiting. The term "image" as used herein encompasses any printed or digital form of text, graphic, or combination thereof. Like terms refer to like elements throughout the description.

Figure 2:
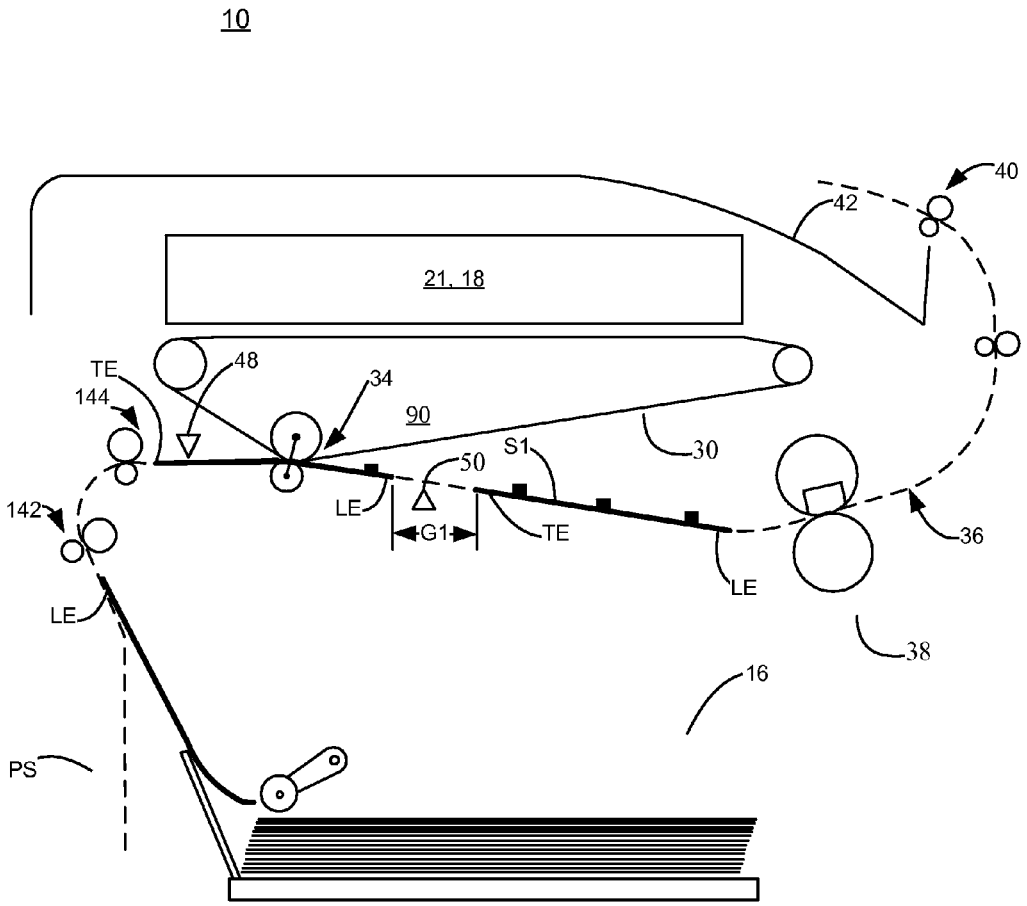
FIG. 2 is a schematic diagram of the imaging apparatus in FIG. 1 illustrating the media feed path from the media input trays to the exit area.

Referring now to the drawings and particularly to FIGS. 1-2, there is shown an imaging apparatus 10. Imaging apparatus 10, which may be a standalone imaging device, includes a housing 12 having a foldout multipurpose media feed tray 14, a moveable media support such as, for example, removable media input tray 16 for supporting sheets of media. The sheets of media may be paper, card stock film, such as transparencies, or printer labels. Multipurpose media feed tray 14 is used to feed a single media sheet or a limited number of media sheets into imaging apparatus 10, such as for example envelopes or letterhead. Multipurpose media feed tray 14 may also be used to feed thicker media that may not be able to accommodate the bends found in the portion of media path leading from media tray 16. Input media tray 16 may be inserted into or removed from the housing 12 through an opening therein.

A user interface 17, such as a graphical user interface, is provided on imaging apparatus 10 for receiving user input concerning operations performed or to be performed by imaging apparatus 10, and for providing to the user information concerning the same. User interface 17 may include a display panel, which may be a touch screen display in which user input may be provided by the user touching or otherwise making contact with graphic user icons in the display panel. The display panel of user interface 60 may be sized for providing graphic and text images that allow for convenient communication of information between imaging apparatus 10 and the user. In addition or in the alternative, user interface 17 may include a plurality of push buttons or keys in addition to the display panel.

With continued reference to FIGS. 1 and 2, imaging apparatus 10 includes one or more imaging stations 18. Each imaging station 18 includes a toner cartridge 20 and an imaging unit 22. Each cartridge 20 includes a toner reservoir to contain toner. In some embodiments, toner cartridge 20 and imaging unit 22 may be combined in a single unit. Each of the imaging stations 18 is mounted such that photoconductor (PC) drums 24 of imaging stations 18 are substantially parallel to each other. In one embodiment, each of imaging stations 18 is substantially the same except for the color of toner stored and transferred. Toner cartridges 20 each contains one of black, magenta, cyan, or yellow toner. In one embodiment, toner cartridges 20 are substantially the same. In another embodiment, toner cartridges 20 include different toner containing capacities.

Each imaging unit 22 includes a charging roll 26, a PC drum 24 and a cleaning blade (not shown). Charging roll 26 forms a nip with a corresponding PC drum 24 and charges the surface of PC drum 24 to a specified voltage. A laser beam from a printhead 21 is directed to the surface of PC drum 24 and discharges those areas it contacts to form a latent image. The developer roll of imaging unit 22 also forms a nip with PC drum 24 and transfers toner thereto to form a toner image. The toner is attracted to the areas of the PC drum 24 surface discharged by the laser beam. The cleaning blade then removes any remaining particles of toner from the PC drum 24 after the toner image is transferred to intermediate transfer mechanism (ITM) 30.

While an electrophotographic printing apparatus is illustrated in imaging apparatus 10, any of a variety of different types of printing mechanisms including dye-sublimation, dot-matrix, or ink-jet printing apparatuses may be used.

In the embodiment shown, ITM 30 is disposed adjacent to each of the imaging stations 18. In this embodiment, ITM 30 is formed as an endless belt trained about a series of rollers and opposed rollers. During image forming operations, ITM 30 moves past each of imaging stations 18 (in a counterclockwise direction as viewed in FIGS. 1 and 2). One or more of PC drums 24 applies toner images in their respective colors to ITM 30. In one embodiment, toner transfer rollers 32 positioned beneath ITM 30 adjacent each PC drum 24 provide a positive voltage field the attracts the toner image from PC drums 24 to the surface of ITM 30. As ITM 30 revolves, it collects the one or more toner images from imaging stations 18 at a first transfer area beneath each of imaging stations 18 and then conveys the toner images to a media sheet at a second transfer area. The second transfer area includes a transfer nip 34 formed between a pair of opposed rollers. Alternative embodiments include those wherein the toner images are applied directly to the media sheet by PC drum(s) 24 in a single toner transfer step.

After receiving the toner images, the media sheets are moved further along the media path 36, indicated by the dashed line in FIG. 2, and into a fuser 38. Fuser 38 includes a fusing roll or belt and a backup roll that form a fuser nip to apply pressure and or heat to the toner image on the media sheet as it passes through the fuser nip. The combination of heat and pressure fuses or adheres the toner image to the media sheet. The fused media sheets then pass through an exit nip of opposed exit rolls 40 that are located downstream from fuser 38 and into an output area 42 or, as known in the art, through a duplex path (not shown) beginning adjacent exit rolls 40 and looping back to the second transfer area and second transfer nip 34 for duplex printing.

In the embodiment illustrated, imaging apparatus 10 is a color laser printer. In another embodiment, imaging apparatus 10 is a mono printer comprising a single toner cartridge 20 and a single imaging unit 22 for forming toner images in a single color. In another embodiment, imaging apparatus 10 is a direct transfer device that transfers the toner images from the one or more PC drums 24 directly to the media sheet. As used herein, the term media sheet is meant to encompass not only paper but also labels, envelopes, fabrics, photographic paper or any other desired substrate that can receive a toner image.

Imaging apparatus 10 further includes a controller 44 that controls the functioning of imaging apparatus 10 and the various components therein such as media feed motors, media sensors, media edge detectors, position detectors, print engines, fusers, etc. Controller 44 oversees the functioning of imaging apparatus 10 including movement of the media along media path 36 via opposed feed and exit rolls, imaging station(s) 18, ITM 30, printheads 21, and user interface 17.

It should be realized that for the various opposed rolls, such as exit rolls 40, feed rolls, transfer rolls, etc., one roll is a driven roll and the other is an idler roll. The driven roll is in operable communication with controller 44. Unless otherwise stated, references to these opposed rolls include both the driven roll and idler roll.

Controller 44 may include a processor unit and an associated memory, and may be formed as one or more Application Specific Integrated Circuits (ASICs). Memory 134 may be any volatile or non-volatile memory of combination thereof such as, for example, to random access memory (RAM), read only memory (ROM), flash memory and/or non-volatile RAM (NVRAM). Alternatively, the memory may be in the form of a separate electronic memory (e.g., RAM, ROM, and/or NVRAM), a hard drive, a CD or DVD drive, or any memory device convenient for use with controller 44. The user interface 17 may include firmware maintained in memory within housing 12 which may be performed by the processor of controller 44 or another processing element.

Mounted adjacent to media path 36 are a plurality of media sensors that are used to detect the leading and trailing edges of a media sheet as it is being transported along media path 36. Media sensor 48 is shown positioned upstream of transfer nip 34. Media sensor 40 is shown positioned downstream of transfer nip 34. It is understood that imaging apparatus 10 may include addition media sensors disposed along media path 36, and the particular location of each media sensor, including media sensors 48 and 50, may vary and depend upon a number of factors. Media sensors 48 and 50 may be any type of sensor that is capable of detecting the leading and trailing edges of a media sheet. For example, each media sensor 48 and 50 may be a photo-interrupter or mechanical flag sensor.

Controller 44, when executing firmware code during a print operation, determines whether there exists a timing problem and take remedial action to complete the print operation without requiring user intervention. In this way, imaging apparatus 100 provides more robust printing performance.

For instance, the timing problem may be a media sheet arriving at a predetermined location upstream of transfer nip 34 along media path 36 prior to printheads 21 being ready to create a latent image on PC drums 24. This may be due to the motor operating printheads 21 not being locked to the desired speed for rotating the mirror for sweeping the scan lines across PC drums 24. The timing problem may also be due to, for example, the laser servo process taking too long to complete, and/or the media sheet arriving earlier than expected at the predetermined location, which may be at media sensor 48. Instead of posting an error and/or entering an error state that would require user intervention before resuming normal operation, as with prior printing devices, imaging apparatus 10 generally transports the affected media sheet(s) along media path 36 without transferring a toner image thereto at transfer nip 34.

The method of operating imaging apparatus 10 when a timing problem arises will be described with respect to FIG. 3, according to an example embodiment. Following to receiving a print request and beginning a print operation, imaging apparatus 10 transports a media sheet from media input tray 16 and moves the sheet towards transfer nip 34. At 302, an error condition, i.e., the timing problem, occurs. In response to the detection, controller 44 of imaging apparatus 10 stops the imaging and/or printing process at 304. At this point, one of two processes may be performed for handling the error condition. The decision for selecting the process to be performed may be based upon a number of factors, such as whether the media sheets have the same source and destination, whether finishing is required, and whether duplex printing is to be performed.

In the event the process referred to as Process 1 is selected, media sheets are stopped from entering media path 36 at 308. In addition, data relating to the media sheets that were in media path 36 at the time of the detection of the error condition but had not yet been imaged, that would be necessary in order for the corresponding images to be printed, are stored in memory and/or recorded at 310. The media sheets that were in media path 36 at the time of the detection of the error condition, both sheets that were imaged and sheets that were not yet imaged, are flushed from imaging apparatus 10 at 312. Following the media sheets being flushed, and upon a determination that printheads 21 are ready to begin imaging, the imaging system of imaging apparatus 10 resumes at 314. Media sheets are picked from media input tray 16 and transported along media path 36 towards transfer nip 34 at 316. Thereafter, normal printing is resumed with the media sheets transported at 316 replacing the unprinted sheets that were flushed from imaging apparatus 10 at 312.

The second process, Process 2, generally involves moving the sheet corresponding to the printing error to output area 42 and imaging with media sheets upstream therefrom. Specifically, upon Process 2 being selected at 306, print engine code is set at 320 to launch an additional sheet of media. The media sheet S corresponding to the error condition continues being transported at 322 until its trailing edge (TE) has passed transfer nip 34. Thereafter, the to-be-printed images of the print job are reassigned to the media sheets upstream of media sheet S at 324. Specifically, the image I that was initially to be printed on media sheet S is reassigned to be printed on media sheet S+1, which is the media sheet immediately upstream of media sheet S, either in media path 36 or the top of the stack of sheets in media input tray 16. Image I+1, which was to be printed on media sheet S+1, is reassigned to media sheet S+2, the media sheet immediately upstream of media sheet S+1, which may be at or near the top of the media stack in media input tray 16. The reassignment proceeds in this way until each image to be printed has been reassigned to a media sheet to immediately upstream of the media sheet to which it had been previously assigned. The imaging system of imaging apparatus 10 is resumed at 326 with a resumption of normal printing. Media sheets S+1, S+2, . . . are transported along media path 36 from media input tray 16 at 328, whereupon the sheets are imaged at second transfer nip 34, fused at fuser 38 and placed in output area 42.

Figure 3:
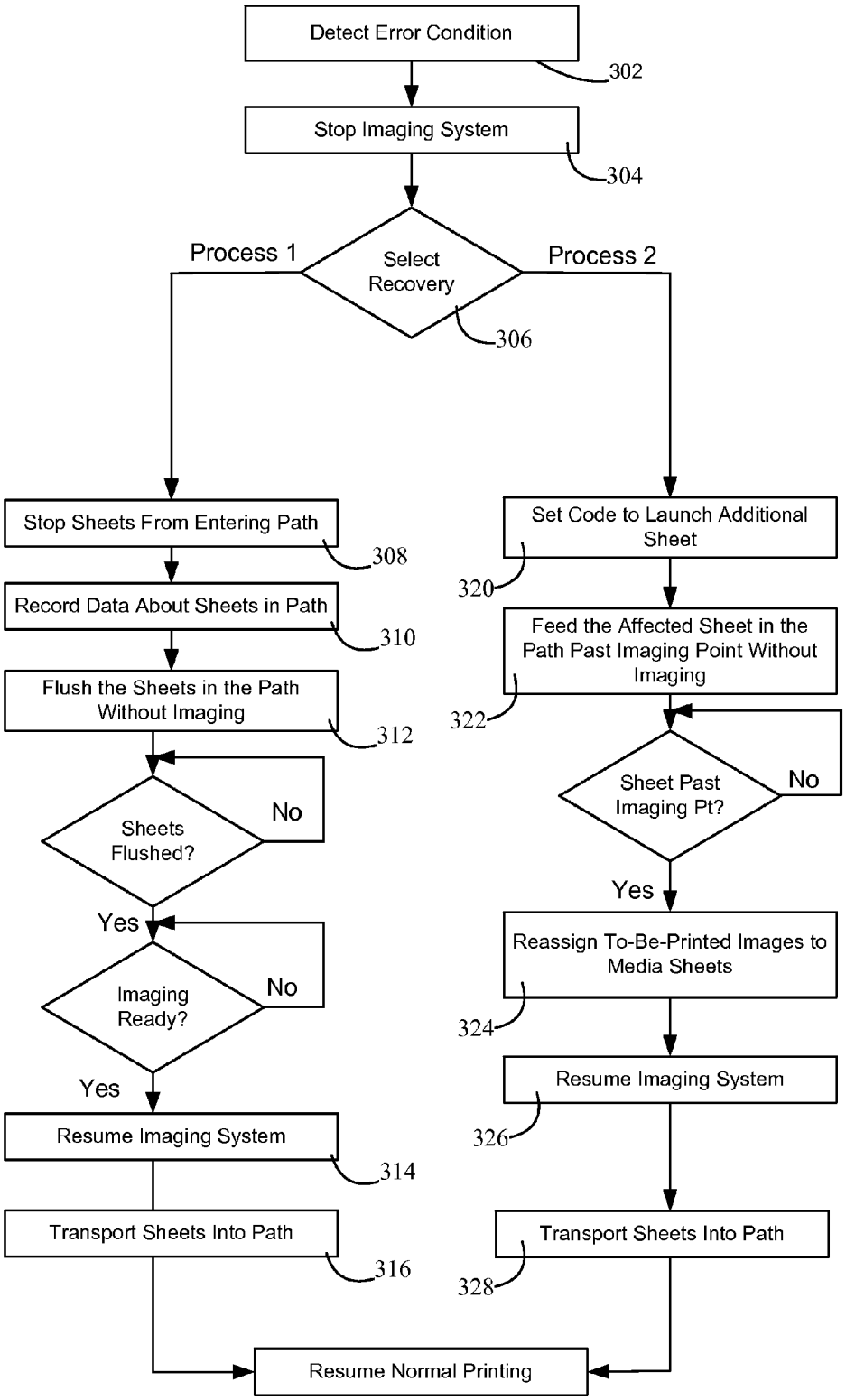
FIG. 3 is a flowchart illustrating a method of operation of the imaging apparatus of FIG. 1, according to example embodiments.

As discussed above, controller 44 causes processes illustrated in FIG. 3 to be performed following an error condition in which the arrival of a media sheet at a predetermined location in media path 36 occurs before the print engine of imaging apparatus 10 is ready to print. In another example embodiment, controller 44 initiates another process upon the occurrence of an error condition in which a small gap or no gap exists between successive sheets of media in media path 36. Example embodiments address gaps having two different sizes—small gaps and tiny gaps that are smaller than small gaps.

Small gaps are gaps between successive media sheets in media path 36 is a gap in which both the TE of a media sheet S and the leading edge (LE) of media sheet S+1 immediately upstream of media sheet S in media path 36 are detected at an input media sensor, such as media sensor 48. With such a small gap, it is possible that no edge, i.e., no gap is detected at an exit sensor, such as media sensor 50 or a sensor located further downstream in media path 36.

Figure 4:
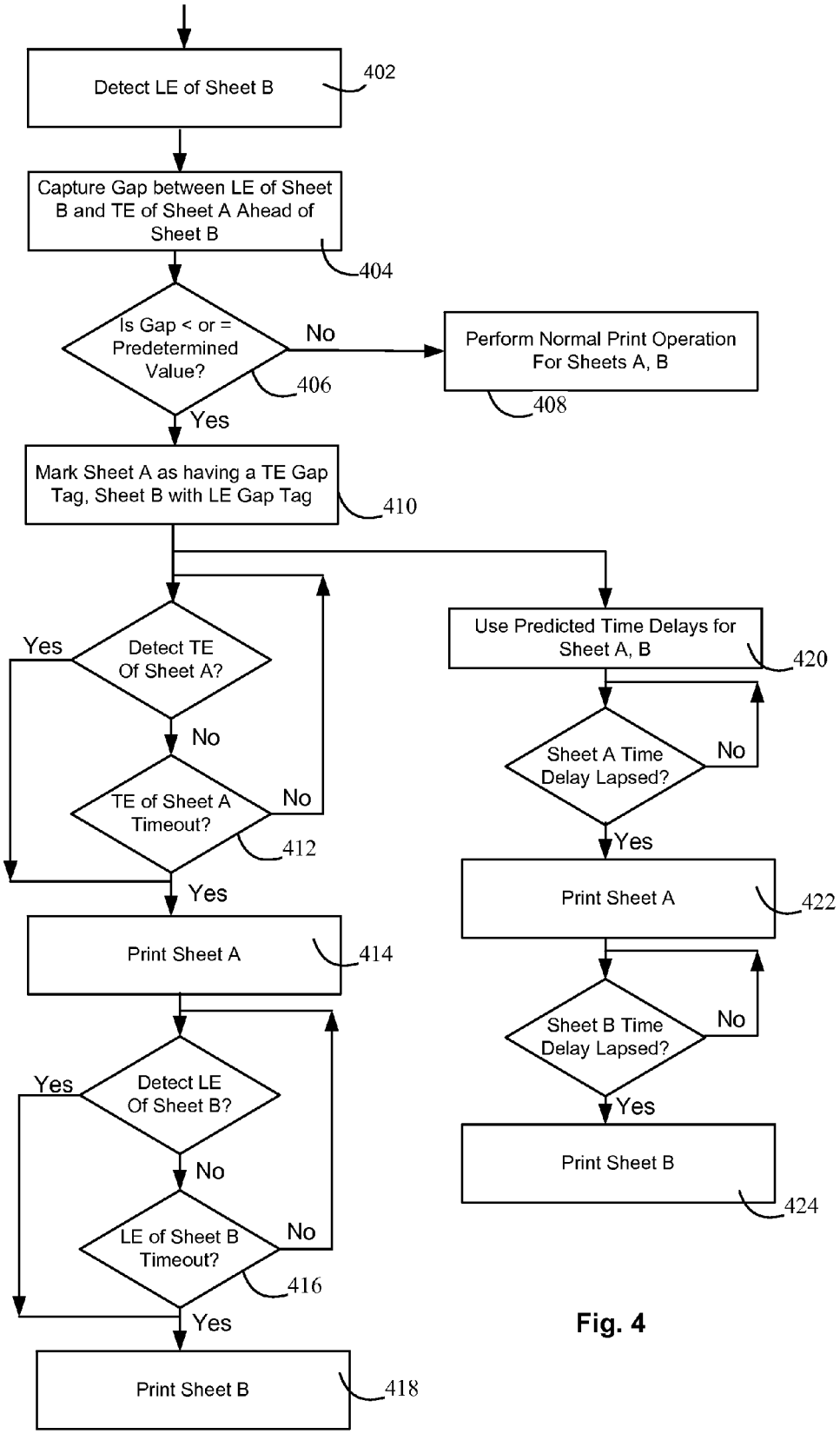
FIG. 4 is a flowchart illustrating a method of operation of the imaging apparatus of FIG. 1, according to example embodiments.

In one example embodiment, either of two approaches may be used to address the condition in which a small gap exists at an input sensor, such as media sensor 48. Both approaches are illustrated in FIG. 4. Initially, following the detection of the TE of sheet B at media sensor 48 (act 402), controller 44 measures or otherwise captures the gap between the TE of downstream sheet A and the LE of sheet B at 404. If the gap between the captured gap is greater than a predetermined gap value at 406, then no error condition is deemed to exist and sheets A and B are printed normally at 408.

In the event, however, that the captured gap is less than or equal to the predetermined gap value at 404, then sheet A is marked with a TE gap tag and sheet B is marked with a LE gap tag at 410. In one of the two approaches identified above, if the TE of sheet A is not detected at media sensor 50 or some other exit sensor in media path 36 during a predetermined timeout period at 412, because sheet A had been marked with a TE tag at 410, it is assumed that the previously detected gap between sheets A and B had closed. In response, controller 44 causes sheet A to be printed at 414. Similarly, if detecting the LE of sheet B at media sensor 50 (or some other exit sensor in media path 36) fails during a predetermined timeout period at 416 while waiting for media sensor 50 to be cleared (from sheet A passing completely through it), because sheet B had been previously marked with a LE tag it is assumed that the previously detected gap between sheets A and B had closed and controller 44 causes sheet B to be printed at 418. The printing on sheets A and B are performed instead of posting a media jam so that there is no interruption with the print operation.

In the second of two approaches, if the measured interpage gap at media sensor 48 is less than the predetermined gap value, it is assumed that the gap will be closed at media sensor 50 (or some other exit sensor), and printing of sheets A and B are set to occur at times sheet A and B are predicted to pass through transfer nip 34. Specifically, following sheets A and B being marked with TE and LE gap tags, respectively, at 410, predicted time delays are assigned to sheets A and B at 420. Thereafter, sheet A is printed at the completion of its predicted time delay at 422 and sheet B is printed at the completion of its predicted time delay at 424. Like in the first approach, in the second approach sheets A and B are printed without posting a media jam so that there is no interruption with the print operation.

FIG. 4 illustrates approaches for addressing a small gap between sheets A and B in media path 36 in which both the TE of sheet A and the LE of sheet B are detected at media sensor 48 or other input sensor disposed along media path 36. An even smaller gap, referred to as a "tiny gap" occurs between sheets A and B when the TE of sheet A is detected at media sensor 48 but the LE of sheet B is not detected due to there being an extremely small or no interpage gap between sheets A and B, and no gap is detected at media sensor 50 (or other exit sensor along media path 36). In prior printing devices, the occurrence of a tiny gap results in a media jam being posted and user intervention being required before printing operations can resume. In an example embodiment of the present disclosure, an additional approach is presented for handling occurrences of tiny gaps which do not require user intervention.

Figure 5:
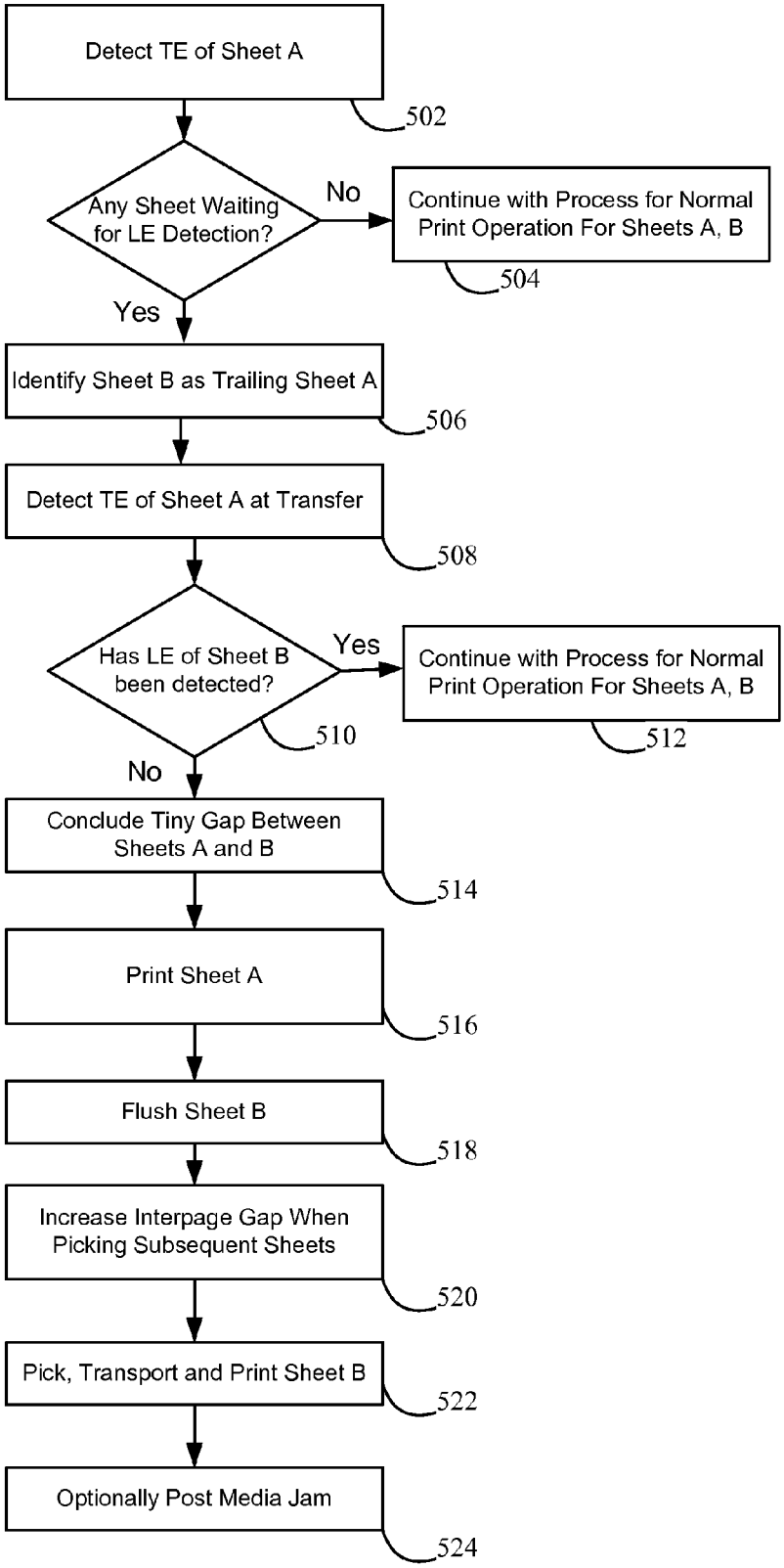
FIG. 5 is a flowchart illustrating a method of operation of the imaging apparatus of FIG. 1, according to example embodiments.

Referring to FIG. 5, at 502 the TE of Sheet A is detected at media sensor 48 (or other input sensor disposed along media path 36). In the event no other sheet in media path 36 is waiting for its LE to be detected, the printing may proceed normally at 504 to print sheet A and subsequent sheets. In the event a sheet in media path 36 does not have its LE detected, the sheet may be identified as immediately trailing sheet A at 506. Following the TE of sheet A being detected at 508 at a location downstream from media sensor 48, such as at transfer nip 34, since sheet B had not had its LE detected at 506, controller 44 checks at 510 whether the LE of sheet B has since been detected. If so, the process continues for printing sheet A and subsequent sheets at 512. However, if the LE of sheet B still had not been detected, controller 44 determines at 514 that a tiny gap exists. Sheet A is printed at 516. Sheet B, and any other sheet in media path 36 that is upstream of sheet B, are flushed from imaging apparatus 10 at 518 without being imaged. In addition, the interpage gap is increased at 520 for subsequent sheets picked from media input tray 16. A sheet C is picked, transported along media path 36 and imaged at 522 to complete the print job, assuming a two sheet print job. Imaging apparatus 10 may optionally also post a media jam condition at 524. Despite experiencing a tiny gap between successive sheets, imaging apparatus 10 is able to complete the print job without posting a media jam condition and requiring user intervention.

The foregoing description of several embodiments has been presented for purposes of illustration. It is not intended to be exhaustive or to limit the invention to the precise designs disclosed, and obviously many modifications and variations may be carried out in other specific ways than those herein set forth without departing from the scope and essential characteristics of the invention. It is intended that the scope of the invention be defined by the claims appended hereto.

What is claimed is:

1. In an imaging apparatus having a media input tray, a print engine, an image transfer nip coupled to the print engine for transferring a toner image to sheet of media, an output area for maintaining imaged media sheets, a media path for transporting the media sheets from the media input tray through the image transfer nip and subsequently to the output area, and a plurality of path media sensors positioned along the media path between the media input tray and the output area, a method for transferring a plurality of images to a plurality of media sheets, the method comprising:

transporting a first media sheet from the media input tray towards the transfer nip;

determining, when the first media sheet reaches a predetermined point in the media path, whether the print engine is ready to transfer a first image of the plurality of images to the media sheet at the transfer nip;

upon a determination that the print engine is not ready, transport the first media sheet through the transfer nip without transferring the first image thereto, until the first media sheet is placed in the output area; and transporting a second media sheet to the transfer nip, transferring the first image to the second media sheet and transporting the second media sheet to the output area.

2. The method of claim 1, further comprising:

following the determination, reassigning the plurality of images to the plurality of media sheets, with the first image being assigned to the second media sheet; and sequentially transporting remaining sheets of the plurality of media sheets to the transfer nip and transferring a corresponding reassigned image to each of the remaining media sheets.

3. The method of claim 2, further comprising transporting an additional sheet to the transfer nip and transferring a last image of the plurality of images to the additional sheet.

4. The method of claim 2, wherein the reassigning occurs following the first media sheet passing the predetermined point.

5. The method of claim 1, further comprising following the determination, transporting any media sheets in the paper path at the time of the determination, in addition to the first media sheet, to the output area without transferring an image thereto.

6. The method of claim 5, further comprising recording data pertaining to the additional media sheets.

7. The method of claim 1, further comprising determining, following the transporting, whether the print engine is ready to transfer the first image, transporting a second media sheet from the media input tray to the transfer nip upon a positive determination and subsequently transferring the first image to the second media sheet.

8. The method of claim 7, further comprising transporting, following the determination that the print engine is ready to transfer the first image, media sheets to the transfer nip and transferring a corresponding image of the plurality of image thereto until all of the images of the plurality of images have been transferred to a media sheet.

9. In an imaging apparatus having a media input tray having a pick mechanism, a transfer nip for transferring a toned image to a media sheet, a print engine, an output area for holding imaged sheets of media, a media path for transporting the media sheet from the media input tray through the transfer nip to receive a toned image from the print engine of the imaging apparatus and subsequently to the output area, and a media sensor positioned along the media path between the transfer nip and the media input tray, a method for transferring a plurality of images to a plurality of media sheets, the method comprising:

transporting a first media sheet and a second media sheet in sequence from the media input tray towards the transfer nip;

determining, at a first predetermined location in the media path, whether a trailing edge of the first media sheet is detected and whether a leading edge of the second media sheet is detected; and upon a determination that the trailing edge of the first media sheet is detected and a determination that the leading edge of the second media sheet is not detected, transferring a first image of the plurality of images to the first media sheet, transporting the first media sheet having the first image to the output area, and transporting the second media sheet to the output area without transferring an image thereto.

10. The imaging apparatus of claim 9, further comprising upon the determination that the trailing edge of the first media sheet is detected and the determination that the leading edge of the second media sheet is not detected, transporting a third media sheet from the media input tray to the transfer nip, transferring a second image of the plurality of images to the third media sheet and transporting the third media sheet with the second image to the output area.

11. The imaging apparatus 10, further comprising prior to transporting the third media sheet from the media input tray, increasing an interpage gap setting to a first interpage gap value.

12. The imaging apparatus of claim 9, further comprising detecting the trailing edge of the first media sheet at a second predetermined location in the media path and determining whether the leading edge of the second media sheet remains undetected following detecting the trailing edge of the first media sheet at the second predetermined location, wherein the transporting of the second media sheet to the output area without transferring an image thereto is based upon the determination that the leading edge of the second media sheet remains undetected following detecting the trailing edge of the first media sheet at the second predetermined location.

13. The imaging apparatus of claim 9, further comprising upon a determination that the trailing edge of the first media sheet is detected and a determination that the leading edge of the second media sheet is detected, transferring an image of the plurality of images to each of the first media sheet and the second media sheet and transporting the first and second media sheets to the output area.

14. The imaging apparatus of claim 13, further comprising determining a size of an interpage gap at the first predetermined location between the first media sheet and the second media sheet, comparing the determined size to a predetermined value and selectively assigning a trailing edge indicator to the first media sheet and a leading edge indicator to the second media sheet based upon the comparison.

15. The imaging apparatus of claim 14, further comprising upon failing to detect the trailing edge of the first media sheet at a second predetermined location during a timeout period, transferring the first image to the first media sheet.

16. The imaging apparatus of claim 14, further comprising upon failing to detect the leading edge of the second media sheet at a second predetermined location after or nearly after a timeout period, transferring the second image to the second media sheet.

17. The imaging apparatus of claim 13, further comprising determining a size of an interpage gap at the first predetermined location between the first media sheet and the second media sheet, comparing the determined size to a predetermined value and selectively applying a first delay value to the first media sheet and a second delay value to the second media sheet based upon the comparison.

18. The imaging apparatus of claim 17, further comprising upon waiting a period of time corresponding to the first delay value from a time the first media sheet passes a second predetermined location, performing the transferring of the image to the first media sheet.

19. The imaging apparatus of claim 18, further comprising upon waiting a period of time corresponding to the second delay value from a time the second media sheet passes the second predetermined location, performing the transferring of the image to the second media sheet.

* * * * *